US011331936B2

(12) United States Patent
Ito

(10) Patent No.: US 11,331,936 B2
(45) Date of Patent: May 17, 2022

(54) SPINDLE AND RECORDING DEVICE

(71) Applicant: SEIKO EPSON CORPORATION, Tokyo (JP)

(72) Inventor: Shun Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 561 days.

(21) Appl. No.: 16/284,180

(22) Filed: Feb. 25, 2019

(65) Prior Publication Data

US 2019/0263154 A1 Aug. 29, 2019

(30) Foreign Application Priority Data

Feb. 26, 2018 (JP) ..... JP2018-031639

(51) Int. Cl.

| | |
|---|---|
| ***B41J 15/02*** | (2006.01) |
| ***B65H 19/12*** | (2006.01) |
| ***B41J 15/06*** | (2006.01) |
| ***B41J 15/04*** | (2006.01) |

(52) U.S. Cl.

CPC ..... *B41J 15/02* (2013.01); *B41J 15/042* (2013.01); *B41J 15/06* (2013.01); *B65H 19/126* (2013.01)

(58) Field of Classification Search

CPC ..... B41J 15/02; B41J 15/042; B41J 15/06; B65H 16/06; B65H 19/126; B65H 75/08; B65H 75/14; B65H 75/30

See application file for complete search history.

(56) References Cited

U.S. PATENT DOCUMENTS

| | | | | |
|---|---|---|---|---|
| 4,623,139 | A * | 11/1986 | Ebata | B41J 29/02 271/272 |
| 6,454,477 | B1 * | 9/2002 | Sugiyama | B41J 13/02 400/636 |
| 8,870,366 | B2 * | 10/2014 | Akatsu | B41J 11/001 347/104 |
| 2008/0277851 | A1 * | 11/2008 | Genta | B41J 15/042 269/56 |
| 2009/0242603 | A1 * | 10/2009 | Kobayashi | B41J 15/04 226/179 |
| 2017/0151815 | A1 * | 6/2017 | Masunaga | B41J 11/485 |

FOREIGN PATENT DOCUMENTS

JP S58-154259 U 10/1983

* cited by examiner

*Primary Examiner* — Matthew G Marini
*Assistant Examiner* — Marissa Ferguson-Samreth
(74) *Attorney, Agent, or Firm* — Workman Nydegger

(57) ABSTRACT

To provide a spindle supporting a roll body on which a sheet-shaped medium is wound and rotationally driving the roll body. The spindle includes a shaft member to be inserted into the roll body, a gear fixed on a tip side of the shaft member in an axial direction, a spacer member contacting both of the shaft member and the gear, and a coupling member coupling the shaft member to the gear. In the axial direction of the shaft member, a contact area of the spacer member and the gear is larger than a contact area of the shaft member and the spacer member. The gear is coupled to the coupling member in the axial direction and the shaft member is coupled to the coupling member in an intersecting direction intersecting the axial direction.

10 Claims, 11 Drawing Sheets

SPINDLE AND RECORDING DEVICE

BACKGROUND

1. Technical Field

The present invention relates to a spindle and a recording device.

2. Related Art

Various recording devices have been used. Among these devices, there is a recording device including a spindle configured to support a roll body on which a sheet-shaped medium has been wound. As spindles that can be used for this kind of recording device, spindles of various configurations have been disclosed.

For example, JP-UM-A-58-154259 discloses a roll paper winding shaft (spindle) that includes a toothed gear (gear) transmitting a rotation force and that can support and wind a roll paper (medium roll body) by inserting a shaft (shaft member) into the roll paper and attaching side plates (flange parts).

However, in a known spindle as disclosed in JP-UM-A-58-154259, in a case that a big and heavy roll body is used or in a case that the spindle is dropped by mistake, there is a case that the spindle is deformed, such as a case that the gear is buckled or a case that the shaft member is inclined with respect to the gear. When the spindle is deformed, there is a case that medium transportation accuracy is reduced.

SUMMARY

An advantage of some aspects of the invention is to suppress the deformation of a spindle configured to support a roll body on which a sheet-shaped medium has been wound.

The spindle according to a first aspect of the invention is a spindle configured to support a roll body on which a sheet-shaped medium is wound and rotationally drive the roll body, the spindle including a shaft member to be inserted into the roll body, a gear fixed on a tip side of the shaft member in an axial direction, a spacer member provided at a position between the shaft member and the gear, and contacting the shaft member and the gear, and a coupling member coupling the shaft member to the gear, wherein in the axial direction, a contact area of the spacer member and the gear is larger than a contact area of the shaft member and the spacer member, and the gear is coupled to the coupling member in the axial direction and the shaft member is coupled to the coupling member in an intersecting direction intersecting the axial direction.

According to the aspect, the spindle includes a spacer member and is configured such that the contact area of the spacer member and the gear is larger than the contact area of the tip of the shaft member and the spacer member in the axial direction of the shaft member. That is, the contact area of the tip of the shaft member and the gear via the spacer member is larger than the contact area of the tip of the shaft member and the gear in a configuration without the spacer member. Thus, it is possible to reduce the load of the shaft member applied to the gear and suppress the buckling of the gear. In addition, the gear is coupled to the coupling member in the axial direction, and the shaft member is coupled to the coupling member in an intersecting direction intersecting the axial direction. That is, the shaft member and the gear are fixed to each other via the coupling member in the axial direction and the intersecting direction intersecting the axial direction. By fixing the shaft member and the gear to each other in the axial direction and the intersecting direction, it is possible to suppress the inclination of the shaft member with respect to the gear. Thus, according to the aspect, it is possible to suppress the deformation of the spindle.

The spindle according to a second aspect of the invention is the spindle according to the first aspect, further including a penetration member penetrating through the shaft member and the coupling member, wherein the gear includes an insertion part into which an outer circumferential part of the shaft member is to be inserted, the shaft member includes a first through-hole penetrating in the intersecting direction at a position where the outer circumferential part is inserted into the insertion part, the coupling member includes a second through-hole penetrating in the intersecting direction and is arranged such that the second through-hole is housed inside the shaft member, the penetration member protrudes from the outer circumferential part and penetrates through both of the first through-hole and the second through-hole, and the insertion part includes a regulation part configured to regulate the movement of the penetration member protruded from the outer circumferential part in a rotation direction of the roll body.

According to the aspect, it is possible to position the coupling member in the shaft member with high accuracy by the penetration member, and effectively regulate the movement of the penetration member (i.e., shaft member) with respect to the gear in the rotation direction of the roll body by the regulation part.

The spindle according to a third aspect of the invention is the spindle according to the second aspect, wherein the regulation part is at least one groove along the axial direction.

According to the aspect, since the regulation part is at least one groove along the axial direction, it is possible to effectively regulate the movement of the shaft member with respect to the gear in the rotation direction of the roll body with the simple configuration.

The spindle according to a fourth aspect of the invention is the spindle according to the second or third aspect, wherein the penetration member is a spring pin, and an outer diameter in a state in which the spring pin is not inserted into the first through-hole and the second through-hole is larger than an outer diameter in a state in which the spring pin is inserted into the first through-hole and the second through-hole.

According to the aspect, the penetration member is a spring pin configured such that an outer diameter in a state in which the spring pin is not penetrating through the first through-hole and the second through-hole is larger than an outer diameter in a state in which the spring pin is penetrating through the first through-hole and the second through-hole. Thus, it is possible to easily position the gear with respect to the shaft member with high accuracy by the spring pin.

The recording device according to a fifth aspect of the invention includes the spindle according to any one of the first to fourth aspects, and a recording part configured to perform recording on the roll body supported on the spindle.

According to the aspect, the deformation of the spindle is suppressed, the reduction of medium transportation accuracy is also suppressed accordingly, and thus, it is possible to perform recording on a medium transported with high transportation accuracy.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording device 1 according to an example of the invention will be described in detail with reference to the accompanying drawings.

First, an overview of the recording device 1 according to the example will be described with reference to FIG. 1 and FIG. 2.

Figure 1:
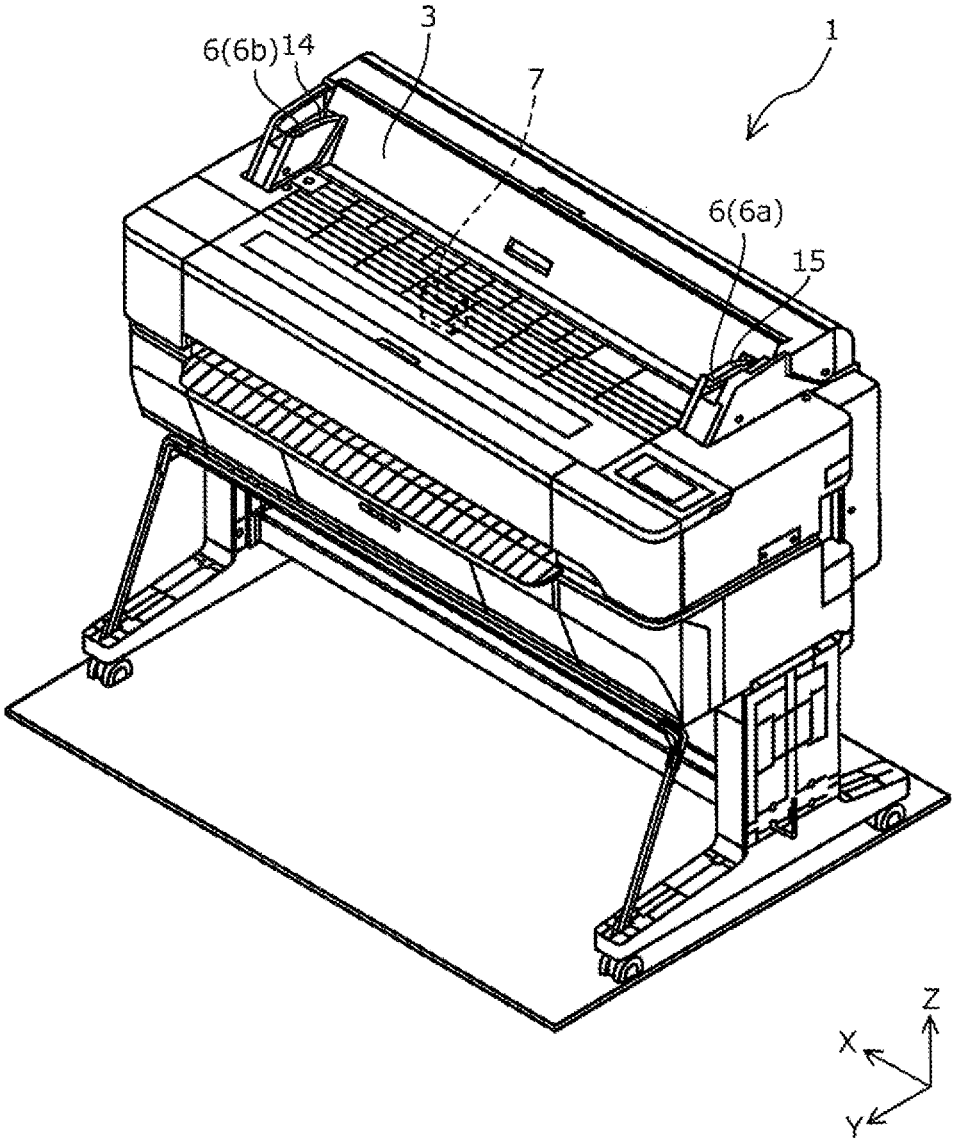
FIG. 1 is a schematic perspective view of a recording device according to an example of the invention.
Figure 2:
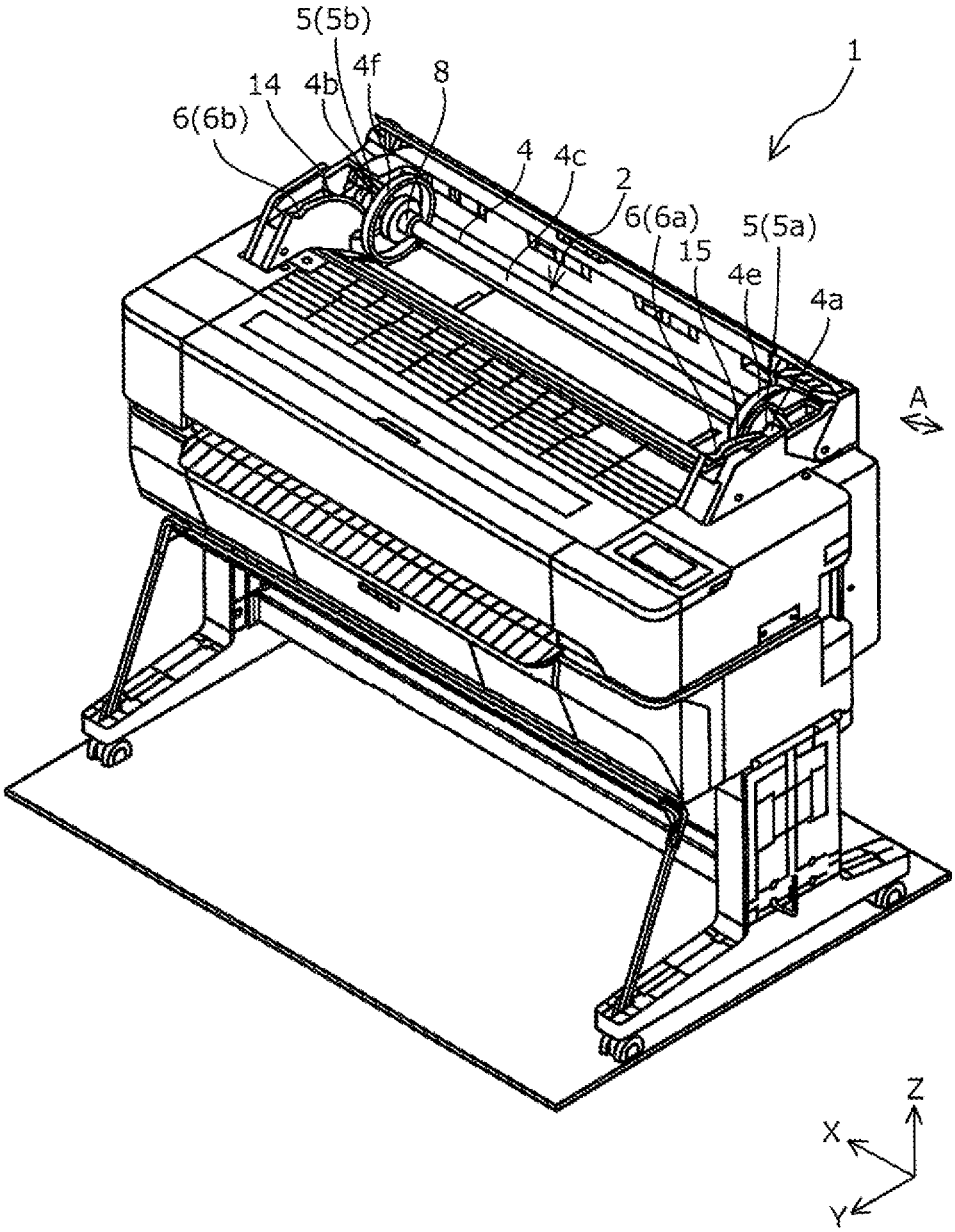
FIG. 2 is a schematic perspective view of the recording device according to the example of the invention.

FIG. 1 and FIG. 2 are schematic perspective views of the recording device 1 according to the example. Among these figures, FIG. 1 represents a state in which a setting part 2 of a roll body (medium roll) on which a sheet-shaped medium has been wound is covered by a cover 3. In addition, FIG. 2 represents a state in which a support part 5 is made to support a spindle 4 that can support a medium roll.

Note that, in FIG. 1 and FIG. 2, some components are represented in dashed lines or omitted such that structures can be easily understood.

Here, an X direction in the figure is a horizontal direction and also a direction in which a shaft member 4*c* of the spindle 4 extends, a Y direction is the horizontal direction and also a direction orthogonal to the X direction, and a Z direction is a vertical direction. In addition, hereinafter, an arrow direction is a +direction, and an opposite direction to the arrow direction is a −direction. For example, a vertically upper direction is a +Z direction, and a vertically lower direction is a −Z direction. In addition, a medium transportation direction is approximately a +Y direction.

The recording device 1 according to the example is a recording device that can perform recording on a roll body on which a sheet-shaped medium has been wound. As represented in FIG. 2, the recording device 1 according to the example includes the setting part 2 including support parts 5 (support part 5*a* and support part 5*b*) that can support the spindle 4 configured to support a medium roll body.

In addition, as represented in FIG. 1, the recording device 1 according to the example includes a head carriage 7 moving in a reciprocating direction (X direction or −X direction) intersecting, or orthogonal to the transportation direction of the medium. The recording device 1 according to the example is configured such that the recording device 1 can perform recording on a medium set in the setting part 2 and transported from the setting part 2 along approximately the +Y direction by discharging an ink from a recording head retained in the head carriage 7.

As described above, in the recording device 1 according to the example, the spindle 4 is made to support the medium roll body. In addition, the spindle 4 supporting the roll body is set in the setting part 2. Here, the spindle 4 in the example includes a shaft member 4*c* made of metal, and a gear 4*d* made of resin (see FIG. 3, etc.) fixed to an end part 4*a* on one side (−X direction side) of the shaft member 4*c* in the axial direction and having a larger outer diameter than the outer diameter of the shaft member 4*c*. In addition, the spindle 4 is configured such that the spindle 4 can support the medium roll body in a state in which the shaft member 4*c* has been inserted into the roll body. The outer diameter of the gear 4*d* is larger than the outer diameter of the shaft member 4*c* to effectively impart a driving force (rotation force) from a driving part provided in the support part 5*a* to the gear 4*d* to transport the medium (i.e., to rotate the spindle 4).

Note that, as represented in FIG. 2, the spindle 4 is set in the setting part 2 such that the end part 4*a* on one side (−X direction side) of the shaft member 4*c* in the axial direction is supported by the support part 5*a*, and an end part 4*b* on the other side (+X direction side) of the shaft member 4*c* in the axial direction is supported by the support part 5*b*. The recording device 1 transports the medium from the medium roll body supported by the spindle 4 set in the setting part 2 to a medium transportation path (not illustrated) in the recording device 1 (specifically, the medium is transported to at least a position facing the head carriage 7). By transporting the medium, the recording device 1 becomes a state in which recording on the medium can be performed.

Here, a position in the spindle 4 at which the medium roll body is set is a position between a flange part 4*e* and a flange part 4*f*. At least one of the flange part 4*e* and the flange part 4*f* is movable in the axial direction (X direction or −X direction) with respect to the shaft member 4*c* and detachable from the shaft member 4*c*. In addition, the spindle 4 is configured such that the medium roll body can be positioned and fixed in the X direction by fixing a paper tube in the roll body on which the medium has been wound to paper tube fixing parts 8 of the flange part 4*e* and the flange part 4*f* (see FIG. 5 to FIG. 7 for the paper tube fixing part 8 of the flange part 4*e*, and see FIG. 2 and FIG. 3 for the paper tube fixing part 8 of the flange part 4*f*).

When the medium roll body is set in the spindle 4, or when the medium roll body supported by the spindle 4 is replaced, etc., the spindle 4 is detached from the setting part 2. The recording device 1 according to the example includes temporary placing parts 6 (temporary placing part 6*a* and temporary placing part 6*b*) for temporary placing the spindle 4 detached from the setting part 2. When the spindle 4 set in the setting part 2 in a state as represented in FIG. 2 is detached, it is possible to once bring the end part 4*b* into a pulled-out state toward the temporary placing part 6*b* (the end part 4*a* is in a state of being supported by the support part 5*a*), and then further bring the end part 4*a* into a pulled-out state toward the temporary placing part 6*a*. That is, since it is possible to pull out the ends of the spindle 4 one by one, the recording device 1 according to the example is configured such that a worker can easily move the spindle 4 from the setting part 2 to the temporary placing part 6 by himself/herself.

Note that, to facilitate the movement of the spindle 4 (to make it possible to roll and move the spindle 4) when the end part 4*b* of the spindle 4 is moved from the support part 5*b* to the temporary placing part 6*b*, a gentle slope 14 is formed between the support part 5*b* and the temporary placing part 6*b*. Similarly, to facilitate the movement of the spindle 4 (to make it possible to roll and move the spindle 4) when the end part 4*a* is moved from the support part 5*a* to the temporary placing part 6*a*, a gentle slope 15 is formed between the support part 5*a* and the temporary placing part 6*a*.

Next, the spindle 4, which is an important part of the recording device 1 according to the example, will be described in detail.

Figure 3:
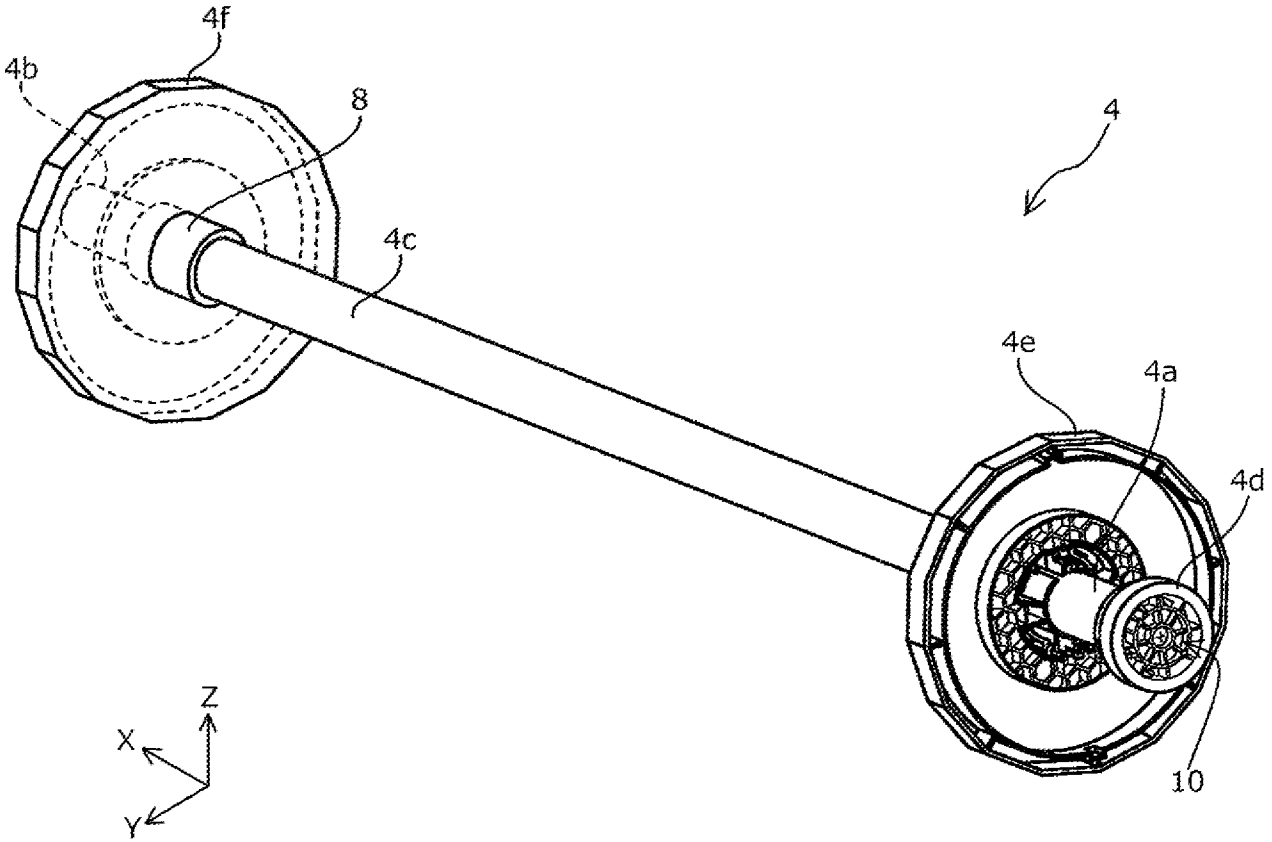
FIG. 3 is a schematic perspective view of the entirety of the spindle of the recording device according to the example of the invention.

Here, FIG. 3 is a schematic perspective view of the entirety of the spindle 4 of the recording device 1 according to the example.

Figure 4:
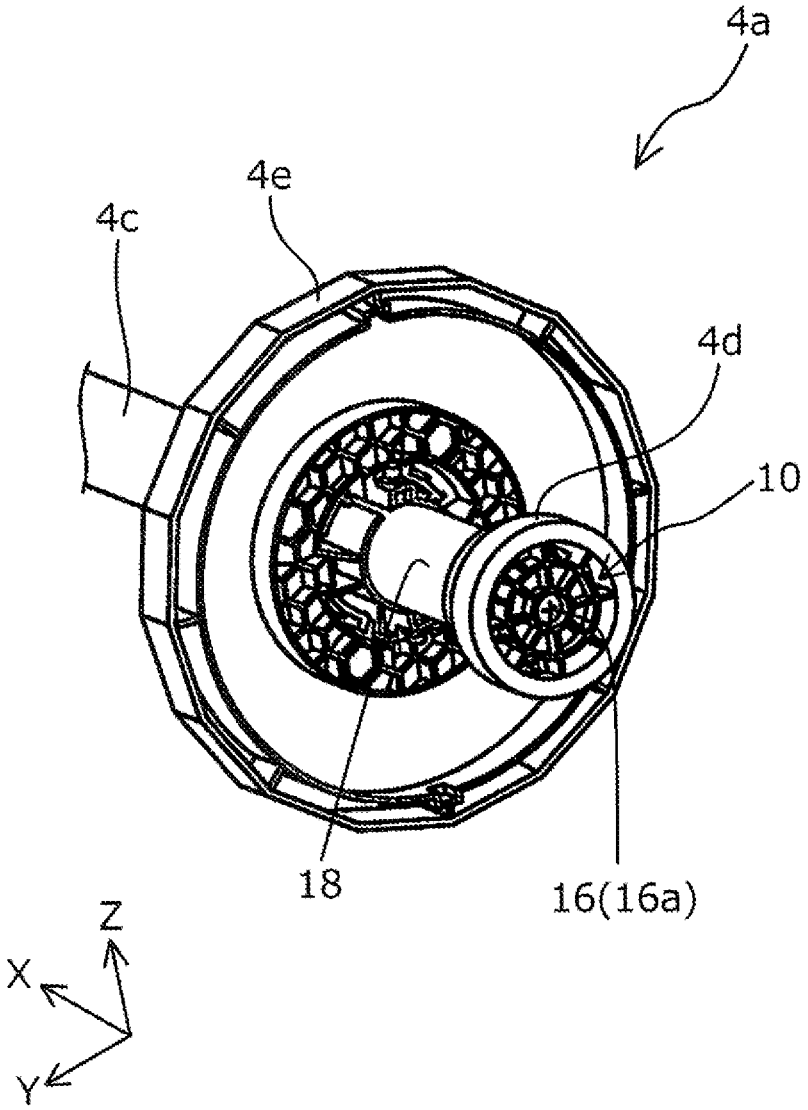
FIG. 4 is a schematic perspective view of part of the spindle of the recording device according to the example of the invention.
Figure 5:
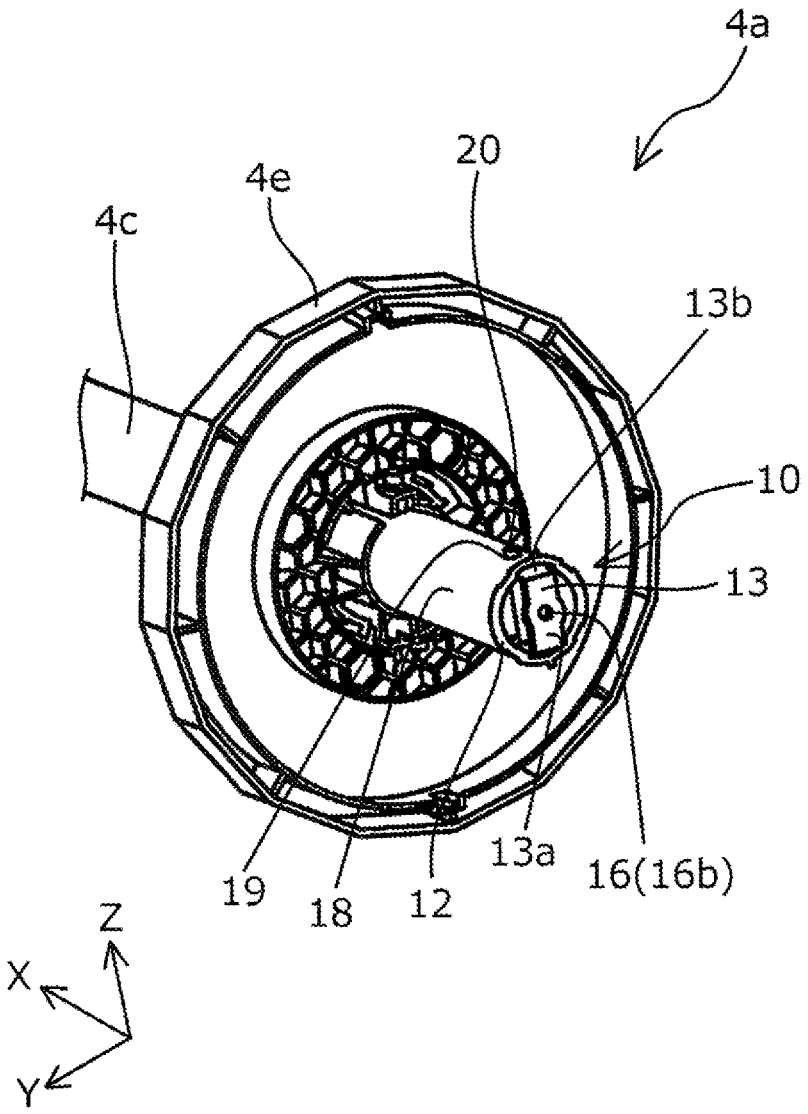
FIG. 5 is a schematic perspective view of part of the spindle of the recording device according to the example of the invention.
Figure 6:
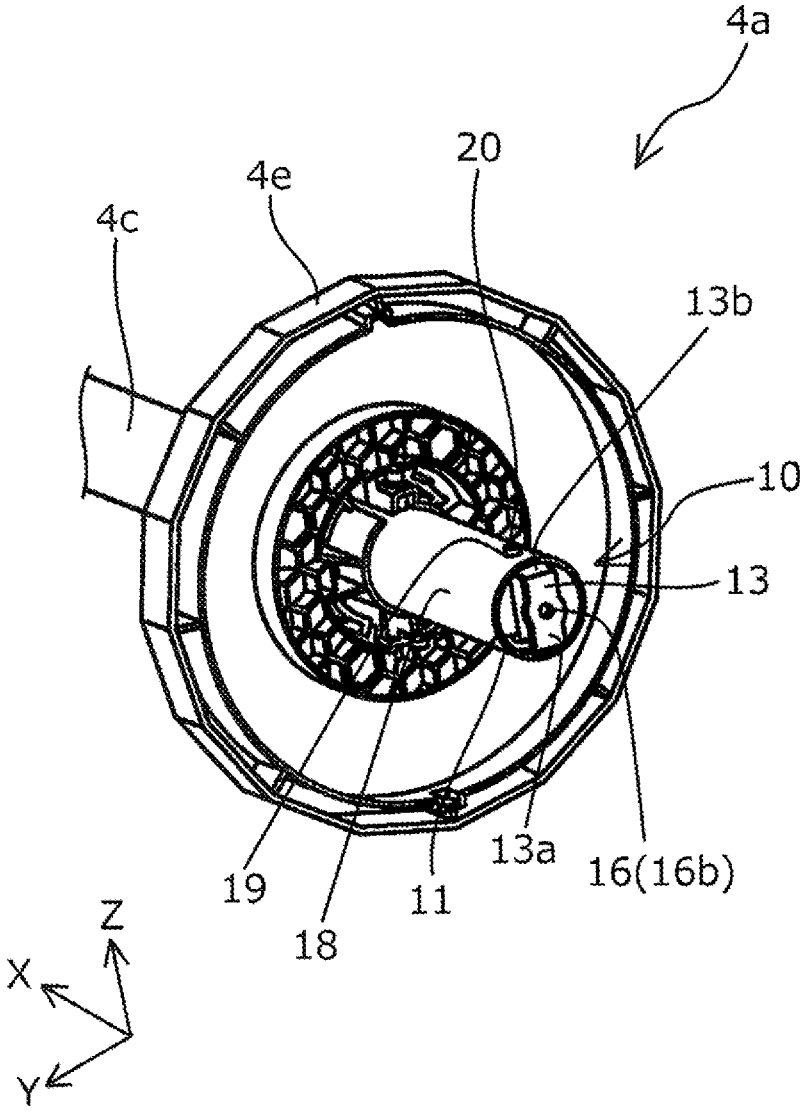
FIG. 6 is a schematic perspective view of part of the spindle of the recording device according to the example of the invention.

In addition, FIG. 4 to FIG. 6 are schematic perspective views of part of the spindle 4 (the end part 4*a* on one side of the shaft member 4*c* in the axial direction) of the recording device 1 according to the example. Among these figures, FIG. 4 is an enlarged view of the end part 4*a* in FIG. 3, FIG. 5 represents a state changed from the state in FIG. 4 in that the gear 4*d* has been detached, and FIG. 6 represents a state changed from the state in FIG. 5 in that a spacer member 12 (ring-shaped and flat-plate-shaped metal washer) has further been detached.

Figure 7:
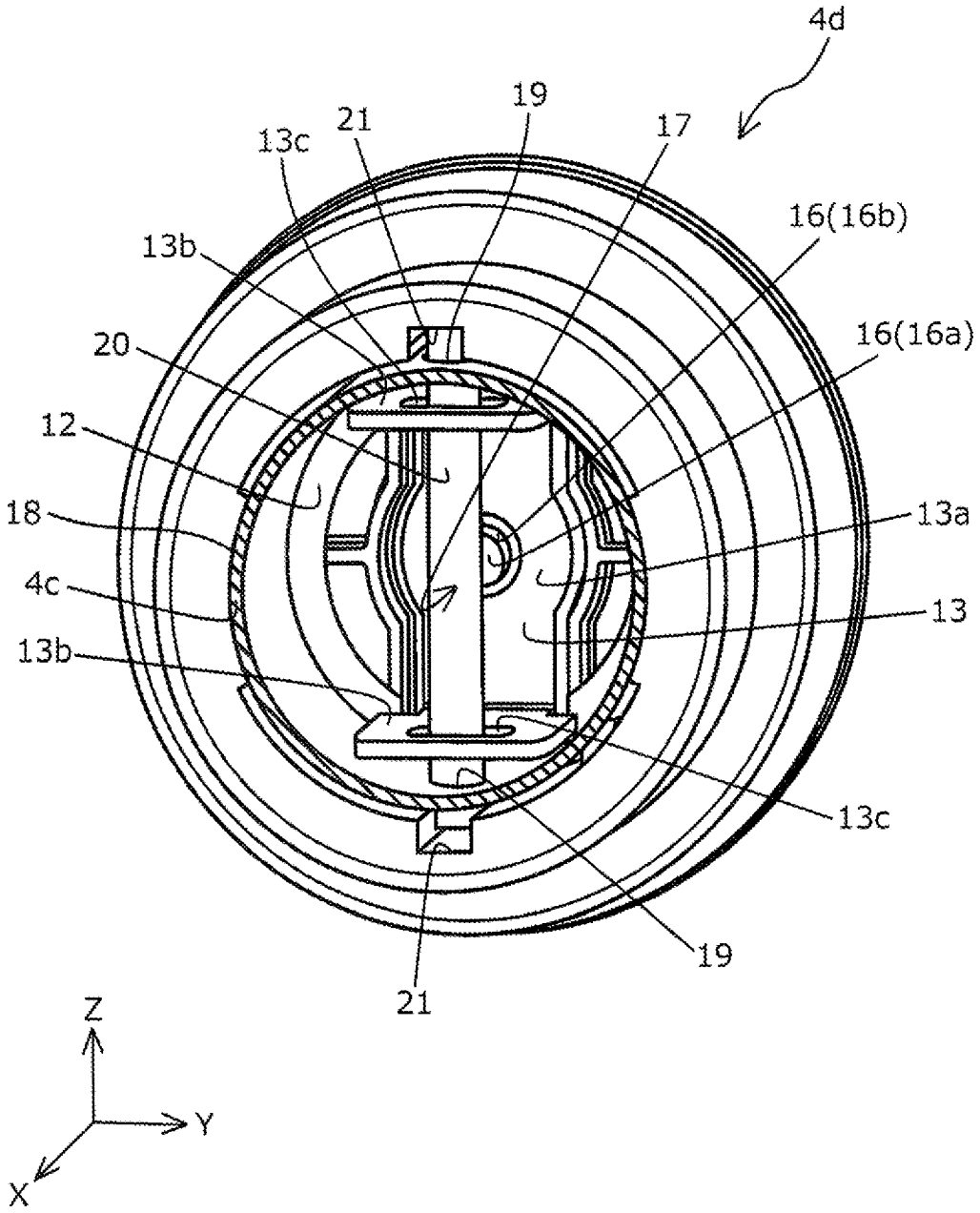
FIG. 7 is a schematic perspective view of the gear of the spindle of the recording device according to the example of the invention.

In addition, FIG. 7 is a schematic perspective view of the gear 4*d* of the spindle 4 of the recording device 1 according to the example, and is a perspective view in which the shaft member 4*c* is cut and the gear 4*d* is viewed from the +X direction side.

Figure 8:
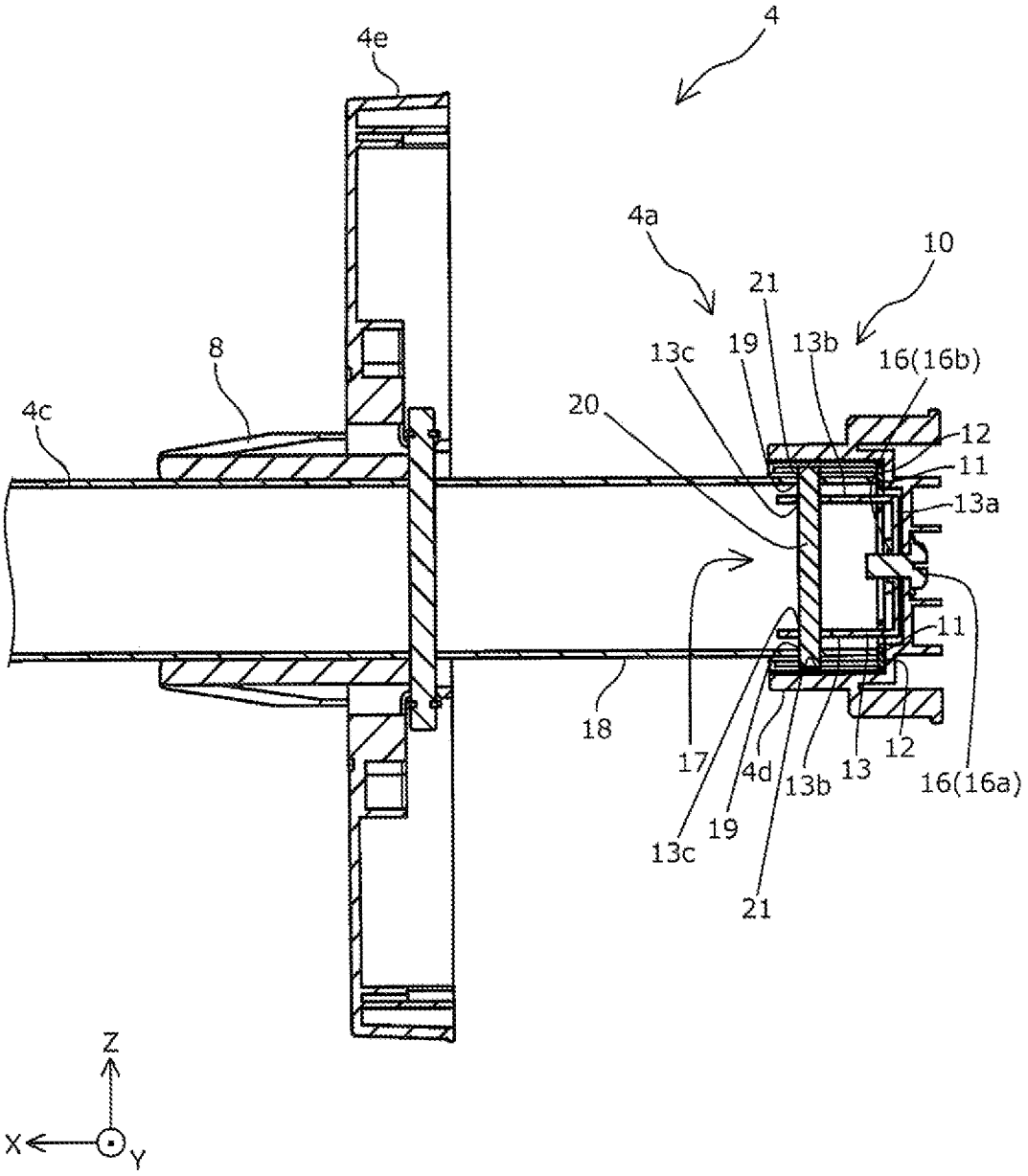
FIG. 8 is a schematic cross-sectional view of part of the spindle of the recording device according to the example of the invention.

In addition, FIG. 8 is a schematic cross-sectional view of the end part 4*a* of the spindle 4 of the recording device 1 according to the example.

Figure 9:
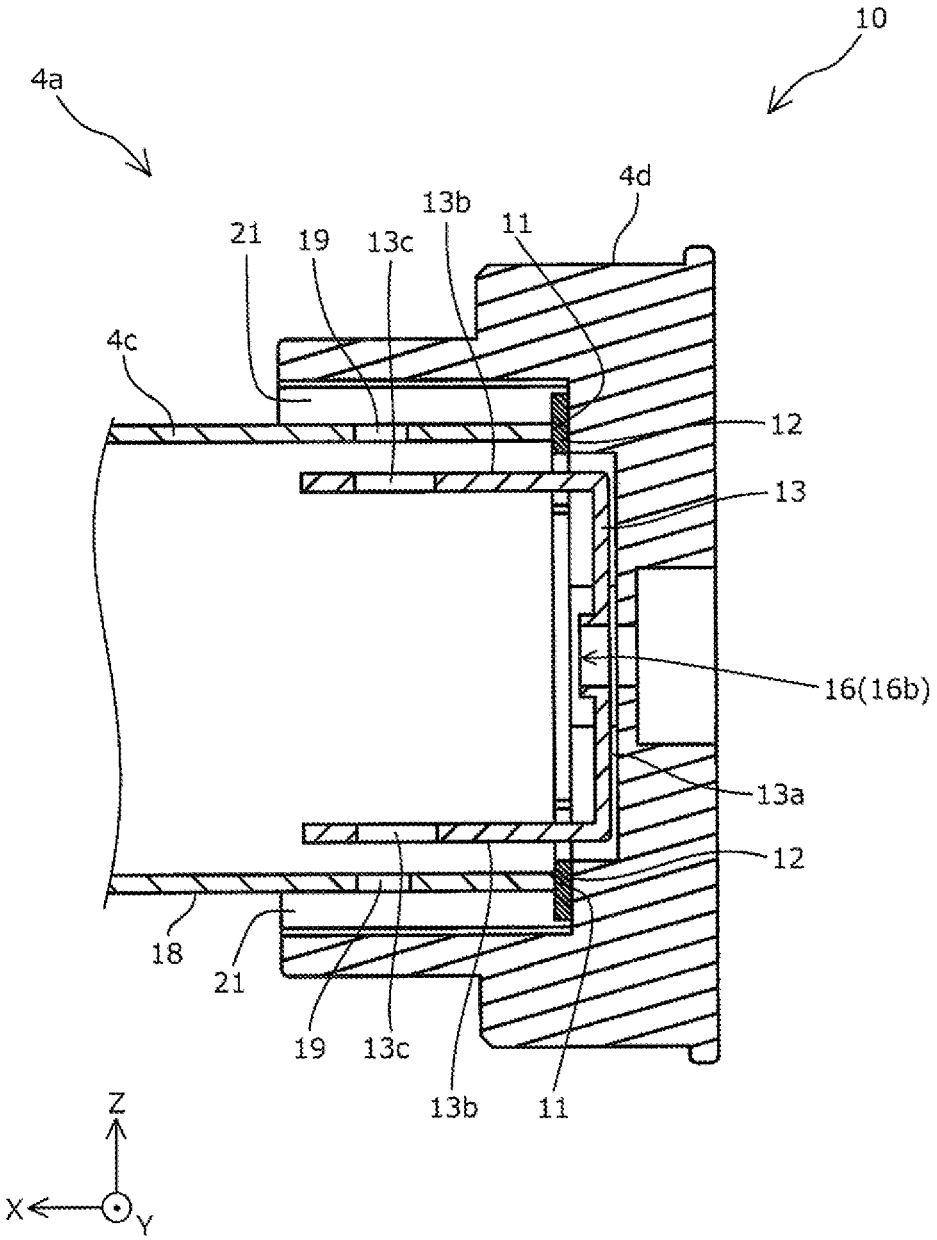
FIG. 9 is an enlarged schematic cross-sectional view of part of the spindle of the recording device according to the example of the invention.
Figure 10:
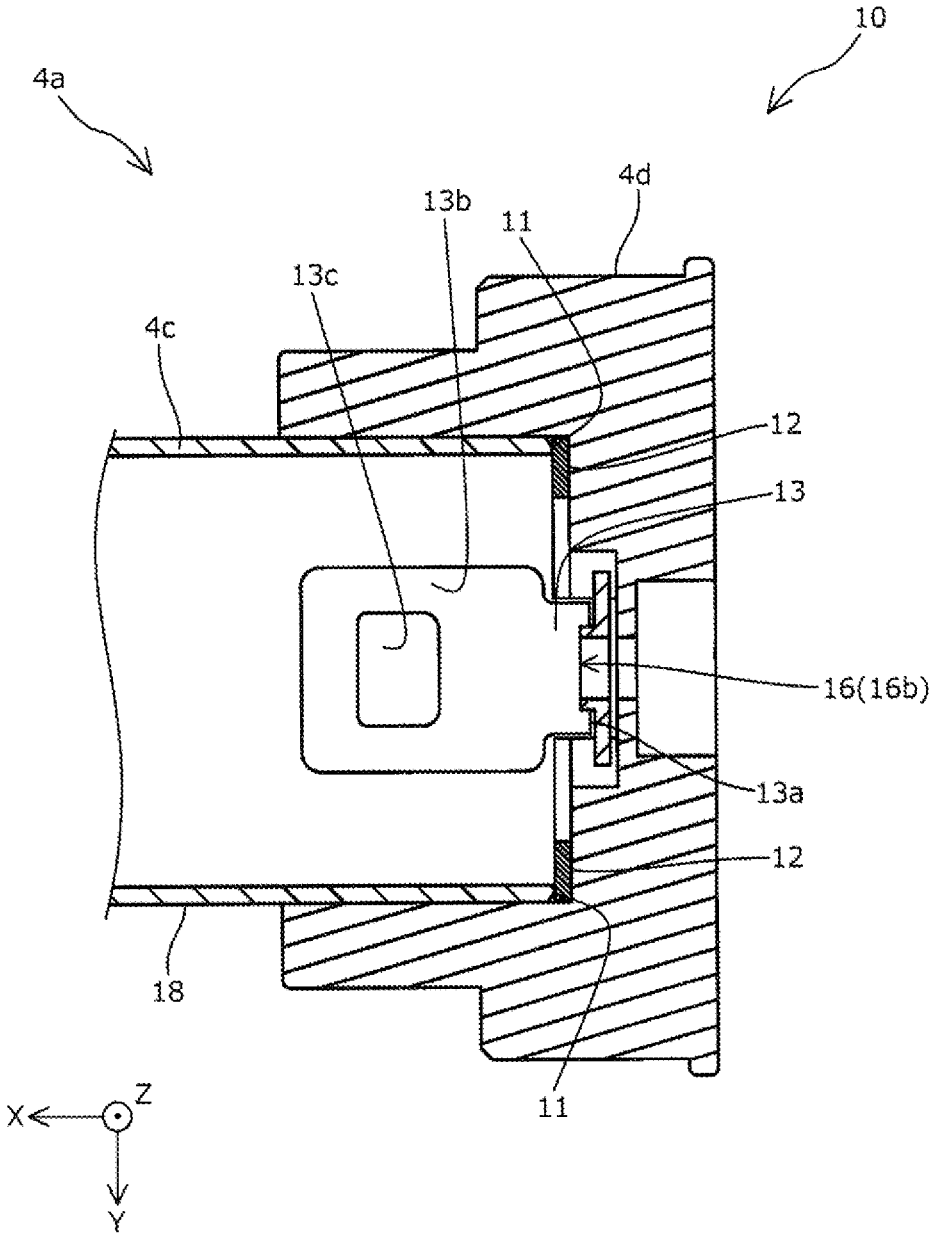
FIG. 10 is an enlarged schematic cross-sectional view of part of the spindle of the recording device according to the example of the invention.

In addition, FIG. 9 and FIG. 10 are enlarged schematic cross-sectional views of a fixing part 10 of the spindle 4 of the recording device 1 according to the example, the fixing part 10 being a part to which the shaft member 4*c* and the gear 4*d* are fixed, and the fixing part 10 being cut at different positions in respective views.

Figure 11:
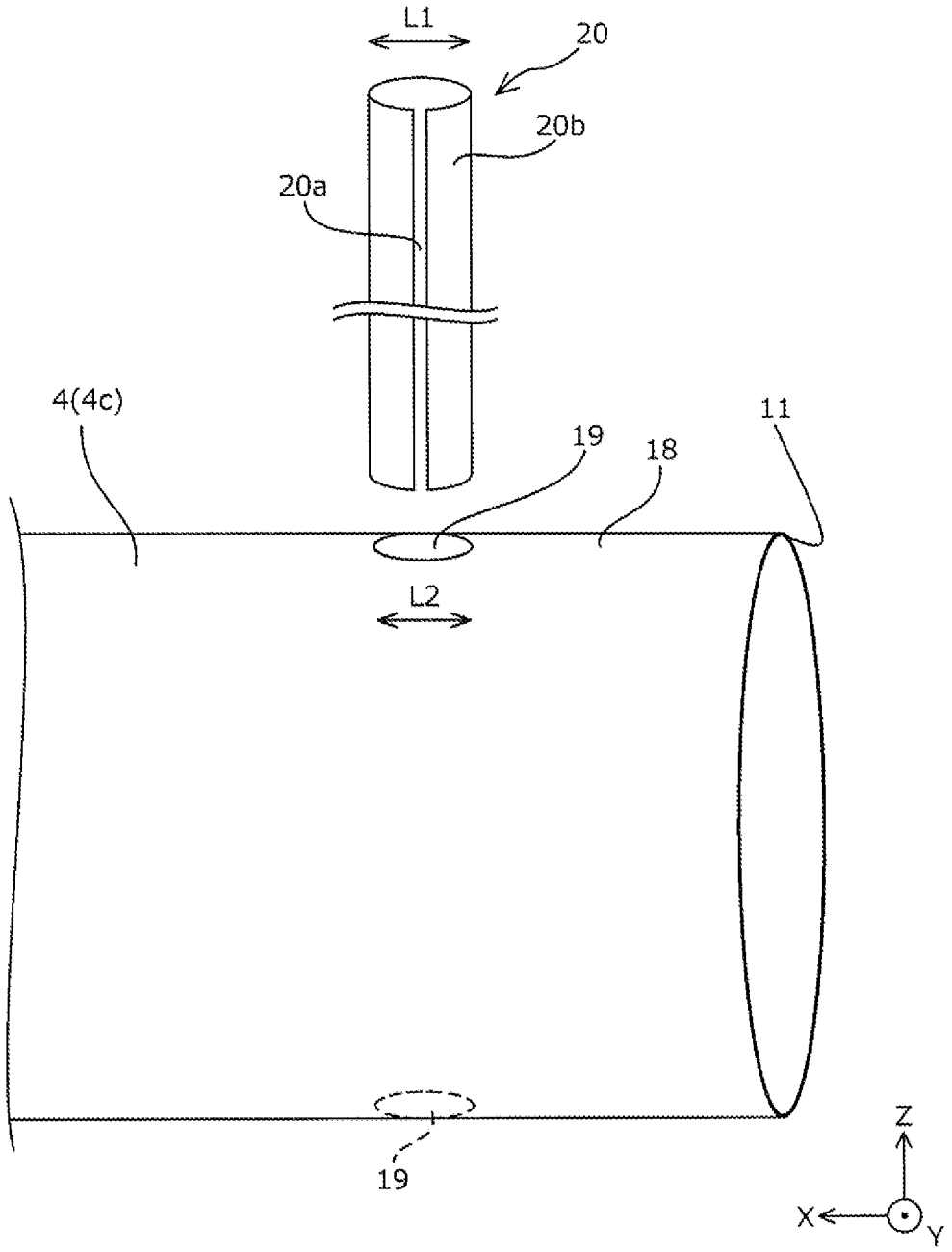
FIG. 11 is a schematic view for describing the spring pin of the spindle of the recording device according to the example of the invention.

In addition, FIG. 11 is a schematic view for describing a spring pin 20 used in the spindle 4 of the recording device 1 according to the example.

Note that, in FIG. 3 to FIG. 11, although the representations are made in reference to a state in which the longitudinal direction of the spring pin 20, which will be described later, is along the Z direction (vertical direction), the arrangements along the Y direction and the Z direction in FIG. 3 to FIG. 11 are merely examples because the spindle 4 is rotated with the shaft member 4*c* as an axial direction (X direction or −X direction).

As described above, the spindle 4 according to the example supports and drives a roll body on which a sheet-shaped medium is wound, and rotates the roll body. In addition, as represented in FIG. 3 and the like, the spindle 4 according to the example includes the shaft member 4*c* to be inserted into the roll body, and the gear 4*d*.

Here, the fixing part 10, which is a part in which the shaft member 4*c* and the gear 4*d* are fixed to each other, will be described.

The gear 4*d* is fixed to the tip side (see FIG. 6, etc.) of the shaft member 4*c* in the axial direction. In addition, a spacer member 12 (see FIG. 5, etc.) contacting both of the shaft member 4*c* (tip 11) and the gear 4*d* is provided at a position between the tip 11 of the shaft member 4*c* and the gear 4*d*. Here, as can be understood by comparing FIG. 5 with FIG. 6, the fixing part 10 according to the example is configured such that, in the axial direction (X direction or −X direction) of the shaft member 4*c*, the contact area of the spacer member 12 and the gear 4*d* is larger than the contact area of the tip 11 of the shaft member 4*c* and the spacer member 12 (i.e., the contact area of the tip 11 of the shaft member 4*c* and the gear 4*d* in a case that the shaft member 4*c* and the gear 4*d* contact with each other with no intervention of the spacer member 12). That is, this configuration makes it possible to reduce the load of the shaft member 4*c* applied to the gear 4*d* and suppress the buckling of the gear 4*d*. Note that, in the example, since the spacer member 12 is made of metal and the gear 4*d* is made of resin, the spacer member 12 is made of a harder material than that of the gear 4*d*. By making the spacer member 12 from a harder material (e.g., having a larger Mohs hardness value) than that of the gear 4*d* as described above, it is possible, in particular, to effectively suppress the buckling of the gear 4*d*, but materials of the spacer member 12 and the gear 4*d* are not particularly limited.

In addition, in the fixing part 10, as represented in FIG. 4 to FIG. 6, and the like, a coupling member 13 including a fixing surface 13*a* for the gear 4*d* at the tip 11 side of the shaft member 4*c* is coupled to the gear 4*d* at the fixing surface 13*a* by a fixing member 16 (screw 16*a* and screw hole 16*b*) in the axial direction of the shaft member 4*c*. In addition, the shaft member 4*c* is coupled to the coupling member 13 in an intersecting direction intersecting the axial direction (X direction or −X direction) of the shaft member 4*c* by the spring pin 20, which will be described later. That is, the shaft member 4*c* and the gear 4*d* are fixed to each other via the coupling member 13 along the axial direction of the shaft member 4*c*, and by employing the configuration in which the shaft member 4*c* and the gear 4*d* are fixed to each other along the axial direction, the inclination of the shaft member 4*c* with respect to the gear 4*d* is suppressed.

Thus, the spindle 4 according to the example is configured as not to be deformed easily.

Note that the coupling member 13 may not be coupled to the gear 4*d* by the screw 16*a* and the screw hole 16*b*. For example, it is possible to provide the fixing surface 13*a* of the coupling member 13 with a convex part protruding in the axial direction, and provide the gear 4*d* with a concave part engaging with the convex part. In this case, it is preferable to provide the concave part of the gear 4*d* with an E-shaped rib (squeezing rib). This makes it possible, when the convex part of the fixing surface 13*a* is inserted into the concave part of the gear 4*d*, to reliably engage the convex part of the fixing surface 13*a* with the concave part of the gear 4*d* by the squeezing rib being squeezed. Thus, it is possible to position the gear 4*d* in the axial direction without the coupling by the screw 16*a* and the screw hole 16*b*.

In other words, the recording device 1 according to the example includes the thus-configured spindle 4 and the head carriage 7 serving as a recording part for performing recording on a roll body supported by the spindle 4, and thus can perform recording on a medium transported with high transportation accuracy.

Hereinafter, the fixing part 10 will further be described in detail.

The spindle 4 according to the example includes the spring pin 20 serving as a penetration member penetrating through the shaft member 4*c* and the coupling member 13. As represented in FIG. 7 and the like, the gear 4*d* includes an insertion part 17 into which an outer circumferential part 18 of the shaft member 4*c* including the tip 11 is to be inserted. As represented in FIG. 9, FIG. 11, and the like, the shaft member 4*c* includes a first through-hole 19 penetrating in the intersecting direction intersecting the axial direction of the shaft member 4*c* at a section on the outer circumferential part 18 to be inserted into the insertion part 17. As represented in FIG. 9, FIG. 10, and the like, the coupling member 13 includes a second through-hole 13*c* penetrating in the intersecting direction on side surfaces 13*b* intersecting the fixing surface 13*a*, and is arranged such that the second through-hole 13*c* is housed inside the shaft member 4*c*. In addition, as represented in FIG. 5 to FIG. 8, the spring pin 20 protrudes from the first through-hole 19 to the outer circumferential part 18, and penetrates through both of the first through-hole 19 and the second through-hole 13*c*. In addition, as represented in FIG. 7, FIG. 8, and the like, the insertion part 17 includes at least one groove 21 serving as a regulation part for regulating the movement, in the rotation direction, of the roll body of the spring pin 20 protruded from the first through-hole 19 to the outer circumferential part 18.

With this configuration, the spindle 4 according to the example can position the coupling member 13 in the shaft member 4*c* with high accuracy by using the spring pin 20. In addition, the spindle 4 according to the example is configured to make it possible to effectively regulate the movement of the roll body of the spring pin 20 with respect to the gear 4*d* in the rotation direction by engaging the at least one groove 21 along the axial direction of the shaft member 4*c* with the spring pin 20 protruded from the first through-hole 19 to the outer circumferential part 18. That is, the spindle 4 according to the example is configured to make it possible to regulate the relative movement of the shaft member 4*c* and the gear 4*d* to each other in the rotation direction of the roll body, and reliably transmit a driving force (rotation force) from the gear 4*d* to the shaft member 4*c*. Note that, although the coupling member 13 according to the example is made of metal and has a U-shape (approximate C-shape) formed by the fixing surface 13*a* and the two side surfaces 13*b* intersecting the fixing surface 13*a*, the material and shape of the coupling member 13 are not particularly limited.

Here, as described above, the regulation part is the at least one groove 21 along the axial direction of the shaft member 4*c*, and thus, the movement of the shaft member 4*c* with respect to the gear 4*d* in the rotation direction of the roll body is effectively regulated with the simple configuration.

In addition, describing the fixing part 10 from a different point of view, in the fixing part 10 according to the example, the shaft member 4*c* is coupled to the coupling member 13 by making the spring pin 20 penetrate through the first through-hole 19 formed in the shaft member 4*c* and the second through-hole 13*c* formed in the coupling member 13. In addition, the coupling member 13 is coupled to the gear 4*d* by engaging, from outside (−X direction side), the screw 16*a* with the screw hole 16*b*, formed in the coupling member 13, with the gear 4*d* interposed therebetween. By fastening the screw 16*a* to the screw hole 16*b* in this state, the gear 4*d* is coupled to the shaft member 4*c* on the +X direction side via the coupling member 13, and the shaft member 4*c* and the gear 4*d* are fixed to each other in the X direction. In addition, the spring pin 20 protrudes from the outer circumferential part 18 of the shaft member 4*c*, and, by the protruded part being housed in the at least one groove 21 along the axial direction (X direction or −X direction) of the shaft member 4*c*, the shaft member 4*c* and the gear 4*d* are fixed to each other also in the rotation direction of the roll body (the movement of the shaft member 4*c* with respect to the gear 4*d* in the rotation direction of the roll body is regulated).

Next, further describing the spring pin 20 serving as a penetration member in detail, the spring pin 20 according to the example is formed by rounding a metal plate having elasticity, and uses the spring action of the cylindrical shape in a radial direction intersecting the axial direction. As represented in FIG. 11, the spring pin 20 has a cylindrical shape, and a gap (space part 20*a*) is formed in the circumferential surface 20*b* along the longitudinal direction. With this configuration, the spring pin 20 according to the example can change the outer diameter thereof.

In addition, specifically, an outer diameter L1 of the spring pin 20 in a state in which the spring pin 20 is not penetrating through the first through-hole 19 and the second through-hole 13*c* is larger than an inner diameter L2 of the first through-hole 19. In addition, by making the spring pin 20 penetrate through (by pushing the spring pin 20 into) the first through-hole 19 and the second through-hole 13*c*, the outer diameter of the spring pin 20 becomes equal to the inner diameter L2 of the first through-hole 19. With this configuration, the spring pin 20 is positioned in the first through-hole 19 with high accuracy and the gear 4*d* is positioned with respect to the shaft member 4*c* with high accuracy (the position shift of the shaft member 4*c* with respect to the gear 4*d* is suppressed).

In other words, the spring pin 20 according to the example has a larger outer diameter in a state in which the spring pin 20 is not penetrating through the first through-hole 19 and the second through-hole 13*c* than an outer diameter in a state in which the spring pin 20 is penetrating through the first through-hole 19 and the second through-hole 13*c*. In other words, the spring pin 20 according to the example has a larger outer diameter in a state in which the spring pin 20 is not inserted into the first through-hole 19 and the second through-hole 13*c* than an outer diameter in a state in which the spring pin 20 is inserted into the first through-hole 19 and the second through-hole 13*c*.

By providing the fixing part 10 with this configuration, the spindle 4 according to the example is configured to make it possible to easily position the gear 4*d* with respect to the shaft member 4*c* with high accuracy by the spring pin 20.

Note that the invention is not intended to be limited to the aforementioned examples, and many variations are possible within the scope of the invention as described in the appended claims. It goes without saying that such variations also fall within the scope of the invention.

This application claims priority under 35 U.S.C. § 119 to Japanese Patent Application No. 2018-031639, filed Feb. 26, 2018. The entire disclosure of Japanese Patent Application No. 2018-031639 is hereby incorporated herein by reference.

What is claimed is:

1. A spindle configured to support a roll body on which a sheet- shaped medium is wound and rotationally drive the roll body, the spindle comprising:

a shaft member to be inserted into the roll body;

a gear fixed on a tip side of the shaft member in an axial direction;

a spacer member provided at a position between the shaft member and the gear, and contacting the shaft member and the gear; and a coupling member coupling the shaft member to the gear, wherein in the axial direction, a first contact area, where the spacer member and the gear are in contact with each other, is larger than a second contact area, where the spacer member and the shaft member are in contact with each other, and the gear is coupled to the coupling member in the axial direction and the shaft member is coupled to the coupling member in an intersecting direction intersecting the axial direction.

2. The spindle according to claim 1, further comprising:

a penetration member penetrating through the shaft member and the coupling member, wherein the gear includes an insertion part into which an outer circumferential part of the shaft member is to be inserted, the shaft member includes a first through-hole penetrating in the intersecting direction at a position where the outer circumferential part is inserted into the insertion part, the coupling member includes a second through-hole penetrating in the intersecting direction and is arranged such that the second through-hole is housed inside the shaft member, the penetration member protrudes from the outer circumferential part and penetrates through the first through-hole and the second through-hole, and the insertion part includes a regulation part configured to regulate movement of the penetration member protruded from the outer circumferential part in a rotation direction of the roll body.

3. The spindle according to claim 2, wherein the regulation part is at least one groove along the axial direction.

4. The spindle according to claim 3, wherein the penetration member is a spring pin, and an outer diameter of the spring pin in a state in which the spring pin is not penetrating through the first through-hole and the second through-hole is larger than an outer diameter of the spring pin in a state in which the spring pin is penetrating through the first through-hole and the second through-hole.

5. A recording device, comprising:

the spindle according to claim 4; and a recording part configured to perform recording on the roll body supported by the spindle.

6. A recording device, comprising:

the spindle according to claim 3; and a recording part configured to perform recording on the roll body supported by the spindle.

7. The spindle according to claim 2, wherein the penetration member is a spring pin, and an outer diameter of the spring pin in a state in which the spring pin is not inserted into the first through-hole and the second through-hole is larger than an outer diameter of the spring pin in a state in which the spring pin is inserted into the first through-hole and the second through-hole.

8. A recording device, comprising:

the spindle according to claim 7; and a recording part configured to perform recording on the roll body supported by the spindle.

9. A recording device, comprising:

the spindle according to claim 2; and a recording part configured to perform recording on the roll body supported by the spindle.

10. A recording device, comprising:

the spindle according to claim 1; and a recording part configured to perform recording on the roll body supported by the spindle.

* * * * *